United States Patent [19]

Faulkner et al.

[11] 4,269,593

[45] May 26, 1981

[54] ROLLER GRATE MATERIAL BED CONVEYING AND HEAT EXCHANGE APPARATUS PROVIDING PLURAL BED DEPTHS

[75] Inventors: Bobby P. Faulkner, New Berlin; Wayne D. Heyer, Greendale; Michael H. Weinecke, Greenfield, all of Wis.

[73] Assignee: Allis-Chalmers Corporation, Milwaukee, Wis.

[21] Appl. No.: 105,981

[22] Filed: Dec. 21, 1979

[51] Int. Cl.[3] ..... F27B 15/00

[52] U.S. Cl. ..... 432/58; 34/240; 432/106; 432/144

[58] Field of Search ..... 432/14, 58, 106, 138, 432/144; 34/240, 236; 198/780, 952; 193/35 R; 209/671

[56] References Cited

U.S. PATENT DOCUMENTS

| | | | |
|---|---|---|---|
| 626,202 | 5/1899 | Dula | 34/240 |
| 1,667,428 | 4/1928 | Mason | 34/236 |
| 3,329,263 | 7/1967 | Rush et al. | 209/662 |
| 3,518,944 | 7/1970 | Patin | 198/780 |
| 3,589,033 | 6/1971 | Bryand | 34/240 |

*Primary Examiner*—John J. Camby
*Attorney, Agent, or Firm*—Lee H. Kaiser

[57] ABSTRACT

Roller grate material bed conveying and heat transfer apparatus which provides plural bed depths has cylindrical horizontal rollers driven in the same direction with gas passage apertures in the rollers and filler members in the nip between adjacent rollers. Means are provided to pass heat transfer gas streams through the bed as the rollers urge the material particles in a direction transverse to the roller axes and continually tumble the particles so that all surfaces thereof are exposed to the gas streams. A first plurality of rollers are positioned in a first generally horizontal plane to receive the material fed to the apparatus, and a second plurality of rollers downstream from the first rollers are at elevations lower than the first horizontal plane and preferably are driven at slower speed than the first rollers to thereby increase the material bed depth downstream from the first horizontal plane as the material particles are hardened by heat and can withstand greater bed depth without crushing. The first rollers and the second rollers may respectively be in the drying and preheating zones of the same iron ore pellet indurating apparatus.

15 Claims, 5 Drawing Figures

ROLLER GRATE MATERIAL BED CONVEYING AND HEAT EXCHANGE APPARATUS PROVIDING PLURAL BED DEPTHS

This invention relates to apparatus for simultaneously conveying and transferring heat to or from a bed of material particles such as iron ore pellets, cement or limestone.

BACKGROUND OF THE INVENTION

Traveling grate conveyors conventionally used for transporting a bed of material in indurating apparatus have a plurality of grate bars, or grate plates affixed at their ends to endless chains which engage sprocket drive wheels. Streams of heating gas are forced through the material bed carried on the grate plates and exchange heat with the material particles in a plurality of heat transfer zones, e.g., initial preheating, drying, preburn and cooling zones. One disadvantage of known traveling grate apparatus is the high heat energy loss which occurs when the grate plates and the grate chain return through the atmosphere, and such heat loss has been measured to be 15 percent of the total energy input required for an iron ore pelletizing plant. Another disadvantage of known traveling grate apparatus is that all of the grate plates and the grate chain are exposed to the hottest indurating temperature and therefore must be of expensive high alloy steel which will withstand the hottest temperature. A still further disadvantage of such traveling grate indurating apparatus is that the bed of material is static on the grate plates with the result that the solid-to-gas contact, as well as the heat transfer between the gas stream and the bed material, are relatively low. The depth of the bed is limited to one value in a traveling grate indurating system because the material is static on the grate plates and consequently the depth of bed cannot be varied when the material, e.g., iron ore pellets, hardens and increases in strength. The static nature of the bed limits the maximum bed depth to that magnitude, e.g., seven inches, which will not result in crushing the green pellets in the lower layers, since crushing of the pellets results in undesired fusion of crushed pellets with consequent partial blocking of the heating gas stream as it passes through the bed.

Apparatus for conveying and sizing material bed particles is disclosed in such patents as U.S. Pat. Nos. 2,974,793; 2,988,781; 3,438,491 and 3,848,744 comprising rotatably driven rollers having progressively increased spacing between adjacent rollers to permit different size particles to fall therethrough. U.S. Pat. No. 3,438,491 discloses such conveying and particle classifying apparatus having rollers covered with abrasive resistant rubber to minimize damage to the rollers, and U.S. Pat. No. 3,848,744 discloses such conveying and classifying apparatus for taconite pellets having rollers with a hard chromium outer surface to provide high resistance to abrasion and damage by the pellets. However such particle conveying and classifying apparatus is not capable of heat exchange with the bed material while it is being conveyed.

OBJECTS OF THE INVENTION

It is an object of the invention to provide improved apparatus for simultaneously conveying and transferring heat to or from a bed of material which eliminates the above disadvantages of traveling grate apparatus and permits a plurality of different bed depths to exist in the same apparatus.

A further object of the invention is to provide improved material bed conveying and heat exchange apparatus which has different depths of the material bed and also provides increased solid-to-gas contact and improved heat transfer between the gas streams and the material particles in comparison to prior art traveling grate apparatus.

Still another object of this invention is to provide improved material bed conveying and heat exchange apparatus which has several different depths of the material bed; does not require the rollers to be constructed of expensive high alloy steel; and also eliminates the heat loss that occurs in traveling grate apparatus when the grate bars and chain return through the atmosphere.

Another object of the invention is to provide improved apparatus for simultaneously conveying and indurating beds of iron are pellets wherein the bed depth in the preheating and preburn and subsequent zones can be deeper than that particular bed depth in the drying zone which would result in crushing green pellets in the lower layers of the bed.

A further object is to provide such improved apparatus for simultaneously conveying and indurating beds of material particles such as iron ore pellets which allows the bed depth to increase as the pellets heat harden and become stronger and can withstand a deeper bed, thereby permitting reduction in size of the indurating apparatus in comparison to conventional traveling grate apparatus for processing the same amount of material.

SUMMARY OF THE INVENTION

Roller grate material bed conveying and heat exchange apparatus in accordance with the invention has a plurality of parallel elongated cylindrical rollers mounted for rotation about their longitudinal axes and rotatably driven in the same direction and elongated filler bars in the nip between adjacent rollers, the rollers having gas passage apertures which permit a heating gas stream to pass through the rollers in a direction transverse to their axes. A first plurality of rollers at the inlet are positioned in a first generally horizontal plane, or tier, (which may constitute the drying zone) and receive material particles such as green iron ore pellets fed to the apparatus to a bed depth which will not result in crushing the pellets. Rollers downstream from the first tier are positioned at elevations lower than the first tier so that bed depth can increase as the material is transported through the drying zone and hardened. Preferably a second plurality of rollers are positioned in a second generally horizontal plane, or tier, lower than the first tier and which may constitute the preheating zone for the iron ore pellets. The rollers, together with the filler bars, form a generally horizontal surface with progressively lower levels in the direction of pellet transport and having continually moving portions which agitate, or tumble the particles so that all surfaces thereof are exposed to the heating gas streams and urge the particles across the generally horizontal surface in a direction transverse to the longitudinal axes of the rollers. Streams of heating gases are passed through the bed in a direction transverse thereto in the various heat transfer zones of the indurating apparatus to thereby heat, dry, harden, chemically convert, and/or cool the iron ore pellets as they are being conveyed. The pellets are hardened sufficiently while being conveyed across the first tier of rollers to be able to withstand greater bed depths without crushing of the pellets, and the depth of bed increases as the pellets are conveyed onto the second tier of rollers which preferably are positioned at a lower level than the first tier. Drive means rotate the second tier rollers at slower speeds then the rollers of the first tier so that the hardened pellets build up to a greater bed depth thereon. The rollers of the first and second tiers may respectively form drying and preheating zones of the same indurating apparatus, and the greater bed depth on the second tier rollers permits reduction in size of the indurating apparatus, in comparison to conventional traveling grate apparatus, for processing the same amount of material.

DESCRIPTION OF THE DRAWINGS

The above and other objects and advantages of the invention will be more readily apparent from consideration of the accompanying drawings wherein.

DESCRIPTION OF PREFERRED EMBODIMENTS

Figure 1:
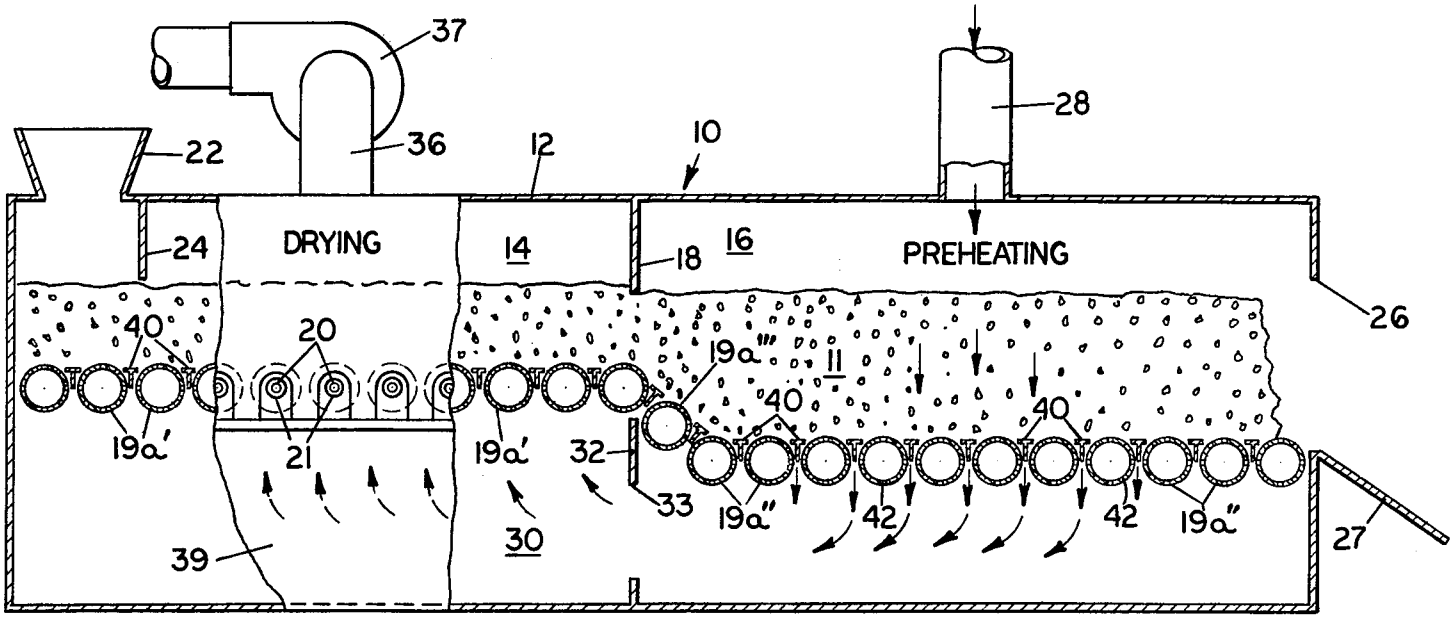
FIG. 1 is a schematic front view, partly in section, of the drying and preheating zones of iron ore pellet indurating apparatus embodying the invention.

Referring to the drawings, FIG. 1 illustrates the drying and preheating zones of roller grate material bed conveying and heat exchange apparatus 10 embodying the invention adapted to transport and heat harden a bed 11 of agglomerated material such as iron ore pellets. Material bed conveying and heat exchange apparatus 10 includes a hood 12 having a drying zone compartment 14; a preheating zone compartment 16; a depending transverse wall, or curtain 18 between the drying and preheating compartments 14 and 16; a plurality of parallel elongated cylindrical rollers 19 affixed to elongated shafts 20 which are mounted for rotation about their longitudinal axes in suitable bearings 21; an inlet hopper 22 for receiving green iron ore pellets from a balling drum and feeding them onto rollers 19 in the drying zone compartment 14; a transverse depending wall member 24 internal of drying zone compartment 14 which establishes the maximum depth of pellets on rollers 19 in the drying zone compartment 14; an outlet 26 from preheating zone compartment 16; a chute 27 adjacent outlet 26 for discharging hardened pellets from the preheating zone compartment 16; and a conduit 28 communicating with preheating zone 16 and receiving hot gases from a kiln or other suitable heat source such as a burner (not shown). Conveying and indurating apparatus 10 may also include a windbox 30 beneath the plurality of rollers 19 and having a transverse wall partition 32 with an opening 33 therein and a conduit 36 which communicates at one end with drying zone compartment 14 and at the other end with the inlet to a suction fan 37 to pull hot gases from windbox 30 upward through bed 11 into drying zone compartment 14 and exhaust them through conduit 36.

The shafts 20 of rollers 19 pass through the sidewalls 39 of hood 12 and are journalled at their ends for rotation about their longitudinal axes in bearings 21 outside the hot zone within hood 12. Each shaft 20 may have a sprocket wheel (not shown) attached at one end for engagement with a driving chain (not shown). Drive means for rotating the plurality of rollers 19 in the same direction are well known, such as disclosed in U.S. Pat. No. 3,438,491, and since they do not constitute part of the invention, the drive means are omitted in order to simplify the description and drawings.

Elongated filler bars 40, preferably of T-shape cross-section, are disposed in the nip between adjacent rollers 19 and are affixed at their ends to sidewalls 39 of hood 12. Filler bars 40 prevent the iron ore pellets from entering the gap between adjacent rollers 19, thereby preventing the pellets from being crushed between adjacent rollers 19 and also preventing the pellets from jamming rollers 19. Filler bars 40 are preferably disposed with the cross-bar of the T-shape cross-section parallel to a plane intersecting the longitudinal axes of the adjacent pair of rollers 19 in order to provide maximum resistance to bending.

Figure 2:
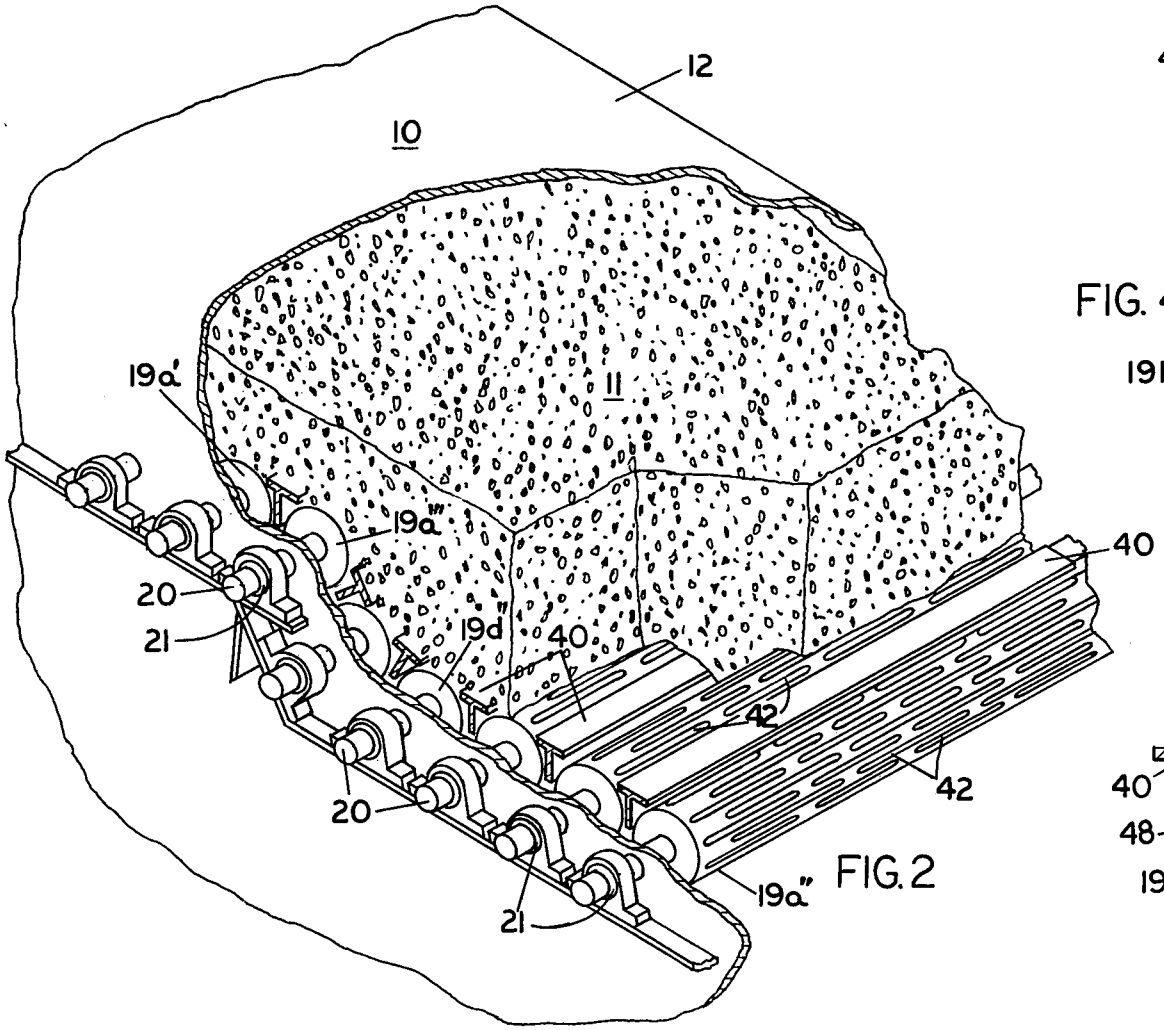
FIG. 2 is a perspective partial view of the FIG. 1 apparatus having rollers with axially elongated slots.

Rollers 19 have gas passage apertures therein which may be of any desired configuration to permit heating gas streams to pass therethrough in a direction transverse to their longitudinal axes. The rollers **19*a* shown in FIGS. 1 and 2 are adapted to convey a bed of material particles such as limestone, oil shale or cement and preferably are hollow and have a plurality of slots 42 elongated in a direction parallel to the roller longitudinal axes. Elongated slots 42 protrude in a radial direction through the cylindrical outer layer of the rollers 19*a***.

Figure 4:
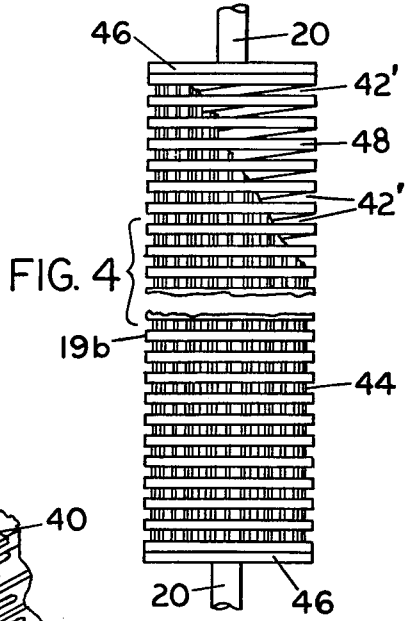
FIG. 4 is a top view, partly broken away, of the roller shown in FIG. 3.
Figure 3:
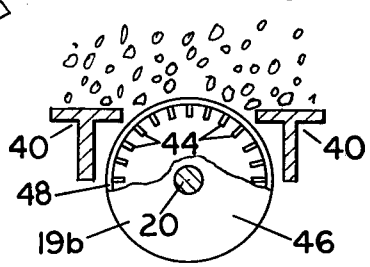
FIG. 3 is a front view of a roller with circumferential slots which is particularly adapted for conveying iron ore pellets and of the adjacent filler bars.

In an alternative embodiment shown in FIGS. 3 and 4 rollers **19*b* have circumferential, or spiral slots 42' therein and are particularly adapted to convey iron ore pellets with minimum breakage. Preferably each roller 19*b* includes a plurality of elongated steel bars 44 welded to a pair to steel circular end plates 46 so that bars 44 are parallel to the roller longitudinal axis and define a right cylinder. The circular end plates 46 are affixed to an elongated shaft 20. An elongated steel rod 48, which, for example, may be of 2 millimeter width, is then wound in spiral, or helical configuration upon the cylinder defined by bars 44 with space between adjacent spiral convolutions. The spiral convolutions of rod 48 are welded to bars 44 and form circumferential slots 42' between adjacent spiral turns of rod 48**.

Breakage of pellets can occur when the rollers **19*a* of the FIGS. 1 and 2 embodiment are used with iron ore pellets and the pellets are caught between the axially extending slots 42 and the filler bars 40, whereas the circumferential slots 42' of the rollers 19*b* have substantially no length parallel to filler bars 40 tending to catch and break a pellet, and consequently pellet breakage is significantly reduced when rollers 19*b*** are used to transport iron ore pellets.

Beds of material particles such as limestone, iron ore pellets and cement can be conveyed on rollers 19 at speeds equal to that typically used on traveling grates. The rollers 19 together with filler bars 40 define a generally horizontal surface with constantly moving portions which urge the material in a direction transverse to the longitudinal axes of the rollers and continually tumble the material particles to thus produce a dynamic bed in which all surfaces of the particles are exposed to the gas streams, the gas-to-solid contact is significantly improved in comparison to traveling grate apparatus, and low spots in the dynamic bed are filled to the prevailing bed depth almost instantaneously. Such a dynamic bed improves heat transfer between the constantly agitated material particles and the gas streams, and also reduces both the pressure drop and the temperature gradient across the bed 11, in comparison to the static bed transported on traveling grate indurating apparatus.

The roller grate conveying and indurating apparatus as described hereinbefore is similar to that disclosed and claimed in copending application Ser. No. 105,982, filed Dec. 21, 1979, in the names of B. P. Faulkner et al entitled Roller Grate Material Bed Transporting and Heat Exchange Apparatus and having the same assignee as this application.

Figure 5:
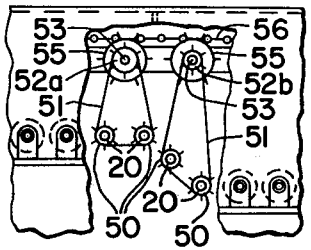
FIG. 5 is a cut-away view showing a portion of the drive means at the back side of the hood shown in FIG. 1 for rotating the rollers at different speeds.

A plurality of first rollers 19*a'* are preferably arranged in a first generally horizontal plane, or tier, within drying compartment 14 and receive the material fed through inlet hopper 22 and convey the bed 11, in a depth which may be established by depending transverse member 24, through the drying zone. A plurality of second rollers 19*a''* within preheating compartment 16 downstream from the first roller 19*a'* are arranged in a second generally horizontal plane at an elevation lower than the first tier. An intermediate roller 19*a'''* may be positioned at an elevation between the first and second tiers so that the horizontal bed-transporting surface defined by rollers 19*a'*, 19*a'''*, and 19*a''* and filler bars 40 is inclined at an angle of approximately 45 degrees to the horizontal at the point between the first rollers 19*a'* and the second rollers 19*a''*. Iron ore pellets on first rollers 19*a'* are hardened by the updraft heating gas stream within the drying zone, and such hardened pellets can withstand greater bed depths without crushing than green nonhardened pellets. The intermediate roller 19*a'''* and the second rollers 19*a''* are driven in the same direction by suitable drive means shown in FIG. 5 at speeds below the speed of first rollers 19*a'* in the first tier so that the depth of iron ore pellet bed 11 increases in the preheating compartment 16. FIG. 5 illustrates that roller shafts 20 are affixed to sprocket wheels 50; that the sprocket wheels on shafts 20 of each pair of adjacent rollers engage a drive chain 51 which is actuated by a drive sprocket wheel 52*a* or 52*b*; that drive sprocket wheels 52*a* and 52*b* are affixed to shafts 53 carrying sprocket wheels 55 which are actuated by a common drive chain 56; and that drive sprocket wheel 52*a* for actuating first rollers 19*a'* has a greater number of teeth than sprocket wheel 52*b* for actuating intermediate roller 19*a'''* and second rollers 19*a''* so they rotate at a slower speed than first rollers 19*a'*. It will be appreciated that such increased bed depth in the preheating zone significantly decreases the size of the indurating apparatus, in comparison to conventional traveling grate systems, while still processing the same amount of material.

It will also be appreciated that the depth of bed can be further increased in any zones, such as a preburn zone (not shown) downstream from the preheating zone, by arranging rollers in a still lower tier and decreasing the roller speed in such preburn zone.

FIG. 1 illustrates that a suction fan 37 pulls the hot kiln-off gases from conduit 28 downdraft in a first heat transfer gas stream through the deeper depth of bed 11 in the preheating zone compartment 16, through opening 33 in wall partition 32 within windbox 30, and then draws the hot gases (which have been reduced in temperature in the preheating zone) updraft in a second heat transfer gas stream which is at a lower temperature than the first stream through the shallower portion of bed 11 to harden the pellets within the drying zone compartment 14 and then exhausts the gases through conduit 36. It will be appreciated that, if desired, a blowing fan (not shown) can be installed in conduit 28 and that other arrangements of suction boxes and blowers can be utilized with windbox 30 to attain any desired pressure drop in the downdraft and updraft direction across material bed 11.

Preferably curtain 18 between drying compartment 14 and preheating compartment 16 extends below transverse wall member 24 and into material bed 11 so that the top layer of moving material hits curtain 18. In this manner curtain 18 provides an excellent seal between drying compartment 14 and preheating compartment 16, and the pressures in the two compartments 14 and 16 do not have to be closely matched.

The disclosed roller grate material bed conveying and heat exchange apparatus eliminates the large heat loss which occurs when the grate plates and chain of a conventional traveling grate conveyor return through the atmosphere, which heat loss has been measured to be approximately 15 percent of the total energy input in an iron ore pelletizing plant. It will also be appreciated that the rollers 19*a'* in drying compartment 14 and rollers 19*a''* adjacent the entrance to preheating compartment 16 are not exposed to the hottest temperature of the indurating system, in the same manner as the grate plates of a conventional traveling grate, and thus such rollers need not be constructed of high alloy steel. Still further, inasmuch as rollers 19 remain in one position, they are exposed to constant temperature, in comparison to the temperature cycle that the grate plates and chain of a traveling grate conveyor undergo, and consequently the thermal stress on rollers 19 is decreased and the life thereof is increased in comparison to the plates of a traveling grate.

We claim:

1. Roller grate apparatus for simultaneously transporting, agitating, and transferring heat to or from a bed of discrete solid mineral particles comprising, in combination, a plurality of parallel elongated cylindrical rollers mounted for rotation about their longitudinal axes certain of which are first rollers and others of which are second rollers, means for rotating said plurality of rollers in the same direction, elongated filler members in the gap between adjacent rollers, said rollers having gas passage apertures therein which permit a heating gas to pass in a generally vertical direction through said rollers, said first rollers being positioned at the inlet to said apparatus in a first generally horizontal plane to receive said mineral particles fed to the apparatus, said second rollers being positioned downstream from said first rollers at elevations lower than said first generally horizontal plane, said first rollers and said second rollers together with said filler members defining a generally horizontal surface having progressively lower levels in the direction of bed transport and having continually moving portions which are adapted to agitate particles and transport said bed across said surface in a direction perpendicular to the longitudinal axes of said rollers at a velocity which is only a minor fraction of the circumferential velocity of said rollers, and means for passing a stream of heat transfer gas in a generally vertical direction through said gas passage apertures and said bed of mineral particles being conveyed on said rollers.

2. Roller grate apparatus in accordance with claim 1 wherein certain of said second rollers are positioned at elevations progressively lower than said first generally horizontal plane in the direction of particle transport.

3. Roller grate apparatus in accordance with claim 1 wherein certain of said second rollers are positioned in a second generally horizontal plane below said first horizontal plane.

4. Roller grate apparatus in accordance with claim 1 or 2 wherein said driving means is adapted to rotate selected ones of said plurality of rollers at a speed different than the speed of other rollers.

5. Roller grate apparatus in accordance with claims 1, 2 or 3 wherein said driving means is adapted to rotate said second rollers at slower speeds than said first rollers to thereby increase the bed depth downstream from said first generally horizontal plane.

6. Roller grate apparatus in accordance with claim 1, 2 or 3 wherein said filler members between adjacent rollers have flat upper surfaces generally parallel to a plane intersecting the longitudinal axes of said adjacent rollers.

7. Roller grate apparatus in accordance with claim 3 having a first heat transfer zone including said first rollers and a second heat transfer zone including said second rollers in said second generally horizontal plane, and wherein said heat transfer gas passing means includes means for passing first and second gas streams at different temperatures through said bed in said first and said second heat transfer zones respectively.

8. Roller grate apparatus in accordance with claim 7 wherein said driving means rotates said second rollers at slower speeds than said first rollers to thereby increase the bed depth in said second heat transfer zone.

9. Roller grate apparatus in accordance with claims 1, 2 or 3 wherein said gas stream passing means includes means for passing a first stream of heat transfer gas through the bed being conveyed by said first rollers and for passing a second stream of heat transfer gas at a different temperature than said first stream through the bed being conveyed by said second rollers.

10. Roller grate apparatus in accordance with claim 9 wherein said driving means rotates said second rollers at slower speeds than said first rollers to thereby increase the depth of the bed being conveyed by said second rollers.

11. Roller grate apparatus in accordance with claim 1 wherein said gas passage apertures are generally circumferential slots in said rollers.

12. Apparatus for simultaneously transporting, agitating and exchanging heat with a bed of discrete solid mineral particles comprising a first heat transfer zone including a plurality of parallel elongated cylindrical first rollers arranged in a first generally horizontal plane, a second heat transfer zone including a plurality of parallel elongated cylindrical second rollers arranged with their axes parallel to the axes of said first rollers in a second generally horizontal plane at a lower elevation than said first horizontal plane, elongated filler members positioned in the nip between adjacent first rollers and also between adjacent second rollers, said first rollers and second rollers defining together with said filler members a generally horizontal surface having progressively lower levels in the direction of bed transport and having continuously moving portions which are adapted to agitate said particles and transport said bed across said surface in a direction perpendicular to the longitudinal axes of said rollers at a velocity which is only a minor fraction of the circumferential velocity of said first rollers and also that of said second rollers, said first rollers and said second rollers have gas passage apertures therein which permit a heating gas stream to pass therethrough in a direction transverse to the roller axes, means for passing a first stream of heat transfer gas through said gas passage apertures and said bed being conveyed on said first rollers and for passing a second stream of heat transfer gas having a different temperature than said first stream through said gas passage apertures and said bed on said second rollers, and drive means for rotating said first rollers and said second rollers in the same direction while rotating said second rollers at slower speed than said first rollers, whereby said bed may build up to a greater depth on said second rollers in said second heat transfer zone.

13. Apparatus in accordance with claim 12 and including a hood enclosing said first and second heat transfer zones and having a depending partition therebetween extending into said bed and providing a seal between said first and second heat transfer zones.

14. Roller grate apparatus in accordance with claim 1 or 7 wherein said heat transfer gas passing means includes a hood enclosing a plurality of said rollers and having sidewalls adjacent the opposite ends of said rollers and forces said gas stream through said bed across the entire width thereof, said plurality of rollers being affixed to shafts which extend through said sidewalls and are mounted for rotation in bearings external of said hood.

15. Roller grate apparatus in accordance with claim 1, 3 or 12 wherein the upper surfaces of said filler members are disposed below the upper surfaces of said adjacent rollers.

* * * * *